US011073327B2

(12) United States Patent
Kim et al.

(10) Patent No.: US 11,073,327 B2
(45) Date of Patent: Jul. 27, 2021

(54) REFRIGERATOR AND CONTROL METHOD OF REFRIGERATOR DOOR

(71) Applicant: Samsung Electronics Co., Ltd., Suwon-si (KR)

(72) Inventors: Woo-Sung Kim, Suwon (KR); Sung Ho Cho, Suwon (KR); Il Sung Bae, Seongnam (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 326 days.

(21) Appl. No.: 15/995,684

(22) Filed: Jun. 1, 2018

(65) Prior Publication Data

US 2018/0347892 A1 Dec. 6, 2018

(30) Foreign Application Priority Data

Jun. 2, 2017 (KR) ..... 10-2017-0069261

(51) Int. Cl.
*A47B 96/04* (2006.01)
*F25D 23/02* (2006.01)
(Continued)

(52) U.S. Cl.
CPC ..... *F25D 23/028* (2013.01); *E05F 15/619* (2015.01); *F25D 23/087* (2013.01);
(Continued)

(58) Field of Classification Search
CPC ..... E05Y 2400/32; E05Y 2400/44; E05Y 2900/31; F25D 23/028; F25D 23/087;
(Continued)

(56) References Cited

U.S. PATENT DOCUMENTS 5,573,323 A * 11/1996 Kim ..... F25D 17/047 312/405
8,469,469 B2 6/2013 Kim et al.
(Continued)

FOREIGN PATENT DOCUMENTS

DE 102011051568 A1 * 4/2012 ..... F25D 23/028
DE 102014107367 11/2015
(Continued)

OTHER PUBLICATIONS

English translation of Shin (DE102011051568) (Year: 2020).*
(Continued)

*Primary Examiner* — Matthew W Ing
(74) *Attorney, Agent, or Firm* — Staas & Halsey LLP

(57) ABSTRACT

A refrigerator may include a main body having a storage room, a door configured to open or close the storage room, a sensing lever configured to contact the door while the door is closed, where the sensing lever is movable in one of a first direction and in a second direction that is opposite to the first direction, a sensor configured to sense a movement of the sensing lever in one of the first direction and the second direction, and a controller configured to open the door when the sensor senses the movement of the sensing lever in the first direction, and to maintain the door closed when the sensor senses the movement of the sensing lever in the second direction.

20 Claims, 20 Drawing Sheets

(51) Int. Cl.
*F25D 29/00* (2006.01)
*E05F 15/619* (2015.01)
*F25D 23/08* (2006.01)

(52) U.S. Cl.
CPC ..... *F25D 29/00* (2013.01); *E05Y 2400/32* (2013.01); *E05Y 2400/44* (2013.01); *E05Y 2900/31* (2013.01); *F25D 2700/02* (2013.01)

(58) Field of Classification Search
CPC .... F25D 29/00; F25D 2700/02; E05F 15/616; E05F 15/619
See application file for complete search history.

(56) References Cited

U.S. PATENT DOCUMENTS

2011/0048060 A1* 3/2011 Kim ..... E05B 17/0029 62/449
2011/0083461 A1* 4/2011 Kim ..... F25D 23/028 62/264
2015/0338156 A1* 11/2015 Held ..... F25D 29/005 312/405
2018/0187470 A1* 7/2018 Song, Il ..... F25D 11/02
2018/0223582 A1* 8/2018 Shin ..... F25D 23/028
2018/0283077 A1* 10/2018 Lee ..... E05D 3/16

FOREIGN PATENT DOCUMENTS

JP 2014-234985 12/2014
KR 10-2009-0012693 2/2009
KR 10-2009-0075278 7/2009
KR 10-2009-0128907 12/2009
WO WO-2007042933 A1 * 4/2007 ..... E05F 11/54

OTHER PUBLICATIONS

English translation of Ortakaya (WO2007042933) (Year: 2020).*
Chinese Office Action dated Mar. 4, 2020 in Chinese Patent Application No. 201810564192.7.
Extended European Search Report dated Oct. 5, 2018 in European Patent Application No. 18175379.9.
Chinese Office Action dated Oct. 21, 2020 in Chinese Patent Application No. 201810564192.7.

* cited by examiner

REFRIGERATOR AND CONTROL METHOD OF REFRIGERATOR DOOR

CROSS-REFERENCE TO RELATED APPLICATION

This application is based on and claims priority under 35 U.S.C. § 119 to Korean Patent Application No. 10-2017-0069261, filed on Jun. 2, 2017, in the Korean Intellectual Property Office, the disclosure of which is incorporated by reference herein in its entirety.

BACKGROUND

1. Field

The present disclosure relates to a refrigerator and a method of controlling a refrigerator door, and more particularly, to a refrigerator of opening a door automatically.

2. Description of the Related Art

In general, a home appliance such as a refrigerator or furniture includes a door for opening or closing a main body.

In the case of a refrigerator, a user opens or closes a door to put food in a storage room or to take food out of the storage room. When the door opens and closes, outside air enters the storage room. The outside air entered the storage room is cooled gradually over time so as to reduce the specific volume so that the inside pressure of the storage room becomes lower than outside pressure. Accordingly, when the user opens the door again, the user should open the door with a force that exceeds the difference in pressure. In some cases, the user should apply a great force to the door in order to open the door. Particularly, in the case of a refrigerator having heavy doors and high-capacity storage rooms, a user should apply a greater force to open the doors. Therefore, a method for easily opening a door is needed.

Meanwhile, between a door and a main body of a refrigerator, a gasket for sealing off a storage room when the door is closed is disposed. The gasket tightly contacts the main body and the door to prevent cool air in the storage room from leaking out of the storage room.

The gasket is made of an elastic material, and absorbs an external impact applied on the main body or another door, as well as a force of pushing the door, thus moving slightly.

SUMMARY

Therefore, it is an aspect of the present disclosure to provide a refrigerator capable of opening a door automatically, and a method of controlling a refrigerator door.

It is another aspect of the present disclosure to provide a refrigerator capable of improving the accuracy of an opening operation and a user's convenience by distinguishing push pressure applied on a door from an external impact applied on the door to determine a user's intention.

Additional aspects of the disclosure will be set forth in part in the description which follows and, in part, will be obvious from the description, or may be learned by practice of the disclosure.

In accordance with an aspect of the present disclosure, a refrigerator may include a main body having a storage room; a door configured to open or close the storage room; a sensing lever configured to contact the door while the door is closed, where the sensing lever is movable in one of a first direction and in a second direction that is opposite to the first direction; a sensor configured to sense a movement of the sensing lever in one of the first direction and the second direction; and a controller configured to open the door when the sensor senses the movement of the sensing lever in the first direction, and to maintain the door in the closed state when the sensor senses the movement of the sensing lever in the second direction.

The refrigerator may further include a gasket disposed on the door, the gasket configured to seal off a gap between the door and the main body, wherein the sensing lever contacts the gasket.

The controller may maintain the door closed, when the sensing lever moves in the second direction according to a vibration of the gasket.

The sensor may include a magnet disposed at one end of the sensing lever, the magnet configured to be movable; and a hall device configured to sense a magnetic field changing based on a movement direction of the magnet.

The controller may determine whether the movement of the sensing lever is in one of the first direction and the second direction based on a voltage value detected by the hall device.

The controller may maintain the door closed based on a number of times a voltage value is detected when the sensing lever moves in the second direction.

The refrigerator may further include an operator configured to open the door, wherein the controller controls the operator based on an amount of the movement of the sensing lever while the sensing lever is moving in the first direction.

The operator may include a driving motor configured to provide a driving force; and a push lever configured to receive the driving force from the driving motor, and to push the door in the second direction.

The operator may further include a deceleration gear configured to reduce rotation displacement of the driving motor, to amplify a driving force of the driving motor, and to transfer the driving force of the driving motor to the push lever.

The operator may further include a rack gear portion configured to convert the rotation displacement of the deceleration gear to linear displacement, and to be engaged with the deceleration gear.

when the sensing lever moves in the first direction, the controller may operate the driving motor, and when the sensing lever moves in the second direction, the controller may not operate the driving motor.

The sensing lever and the sensor may be disposed on a top or a bottom of the door.

The sensor may include a magnet; and a hall device disposed on one end of the sensing lever, the hall device configured to move, wherein the controller may determine whether the sensing lever moves in the first direction or the second direction based on a voltage value detected by the hall device.

The magnet may be installed in the door.

In accordance with another aspect of the present disclosure, a method of controlling a door of a refrigerator, the refrigerator including a sensing lever contacting the door when the door is in closed, where the sensing lever is configured to be movable in one of a first direction and in a second direction that is opposite to the first direction, the method may include sensing a movement of the sensing lever in one of the first direction and the second direction; opening the door based on sensing of the sensing lever in the first direction; and maintaining the door closed based on sensing of the sensing lever in the second direction.

The maintaining of the door closed may include maintaining the door closed based on a number of times the sensing lever moves in the second direction.

The sensing of the movement of the sensing lever in one of the first direction and the second direction may include detecting a magnetic field change based on the movement of the sensing lever.

The opening of the door is based on an amount of the movement of the sensing lever in the first direction.

The opening of the door may include controlling a push lever configured to move the door in the first direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
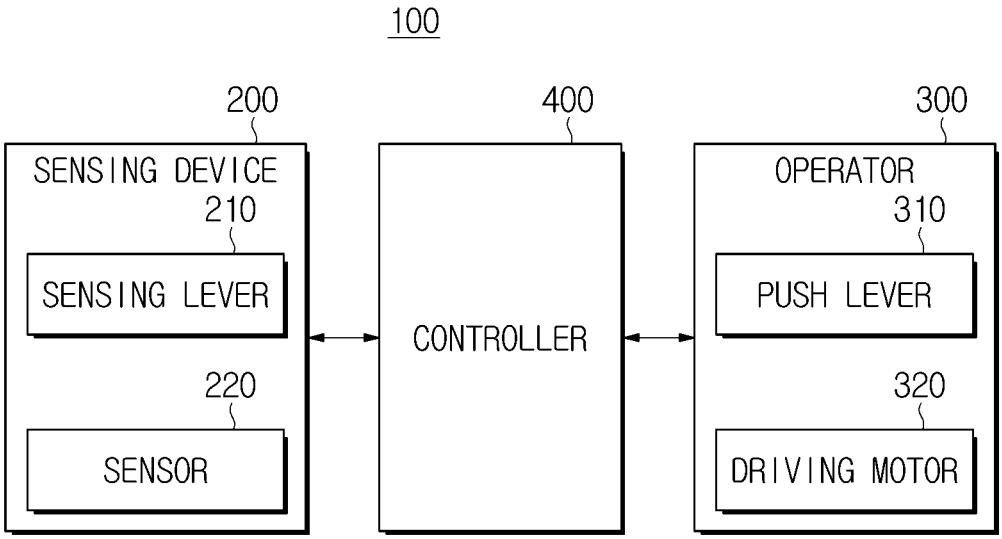
FIG. 1 is a control block diagram of a door opening apparatus according to an embodiment.

Like numbers refer to like elements throughout this specification. This specification does not describe all components of the embodiments, and general information in the technical field to which the present disclosure belongs or overlapping information between the embodiments will not be described. The terms "portion", "module", "element", and "block", as used herein, may be implemented as software or hardware, and according to embodiments, a plurality of "portion", "module", "element", and "block" may be implemented as a single component, or a single "portion", "module", "element", and "block" may include a plurality of components.

It will be understood that when a component is referred to as being "connected" to another component, it can be directly or indirectly connected to the other component. When a component is indirectly connected to another component, it may be connected to the other component through a wireless communication network.

Also, it will be understood that when the terms "includes," "comprises," "including," and/or "comprising," when used in this specification, specify the presence of a stated component, but do not preclude the presence or addition of one or more other components.

It will be understood that, although the terms first, second, etc. may be used herein to describe various components, these components should not be limited by these terms. These terms are only used to distinguish one component from another.

It is to be understood that the singular forms "a," "an," and "the" include plural referents unless the context clearly dictates otherwise.

Reference numerals used in operations are provided for convenience of description, without describing the order of the operations, and the operations can be executed in a different order from the stated order unless a specific order is definitely specified in the context.

Hereinafter, an operation principle and embodiments of the present disclosure will be described with reference to the accompanying drawings.

FIG. 1 is a control block diagram of a door opening apparatus according to an embodiment. Referring to FIG. 1, a door opening apparatus 100 may include a sensing device 200 for sensing a user's push pressure and an impact applied on a door 20 (see FIG. 2) from the outside, an operator 300 for opening the door 20, and a controller 400 for determining whether to drive the operator 300 based on a measurement value received from the sensing device 200.

More specifically, the sensing device 200 may include a sensing lever 210 that is pressed by the door 20 when the door 20 is pressed, and a sensor 220 for sensing a movement direction and a movement amount of the sensing lever 210.

The sensor 220 may be a hall sensor or a mode switch. In the following description, the sensor 220 is assumed to be a hall sensor.

The operator 300 may provide a physical force for opening the door 20 based on the result of sensing by the sensing device 200. More specifically, the operator 300 may include a push lever 310 for pushing the door 20 in a front direction, and a driving motor 320 for converting an electrical force to a driving force.

The controller 400 may be a processor for controlling the sensing device 200 and the operator 300.

The controller 400 may determine whether to drive the operator 300 based on the result of sensing by the sensing device 200. For example, a user may push the door 200 in a rear direction. If the sensing device 200 senses the user's force (hereinafter, referred to as push pressure) applied on the door 20, the controller 400 may control the operator 300 based on a result value of the sensing by the sensing device 200. Also, the controller 400 may determine that the result of the sensing by the sensing device 200 is no push pressure for opening the door 20. In this case, the controller 400 may does not control the operation of the operator 300, so that the door 20 may be maintained in a closed state.

The controller 400 may be implemented with memory (not shown) that stores algorithms for controlling the operations of components in the door opening apparatus 100 or data for programs for executing the algorithms, and a processor (not shown) that performs the above-described operations using the data stored in the memory. The memory and the processor may be implemented as separate chips. Alternatively, the memory and the processor may be integrated into a single chip.

For example, if the door opening apparatus 100 is included in a refrigerator 1 (see FIG. 2), the controller 400 may be controlled by a main micom (not shown) of the refrigerator 1. In this case, the controller 400 may include a communication device for communicating with the main micom, and a storage device (not shown) for storing control commands and various data.

Meanwhile, the refrigerator 1 may include other components than the door opening apparatus 100, and include various devices for performing general operations of the refrigerator 1.

Figure 2:
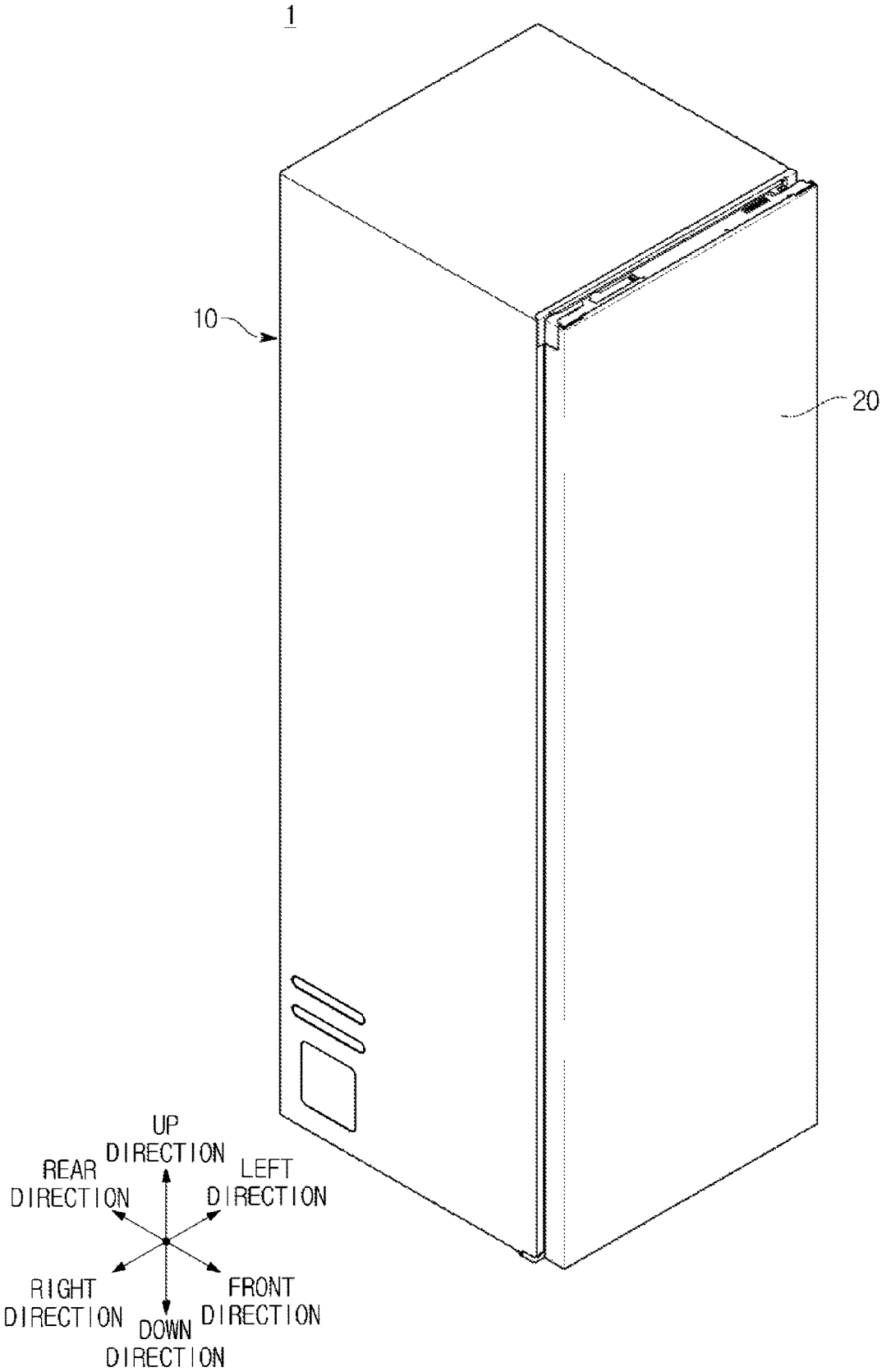
FIG. 2 shows an outer appearance of a refrigerator including a door opening apparatus according to an embodiment, when a door is in a closed state.
Figure 3:
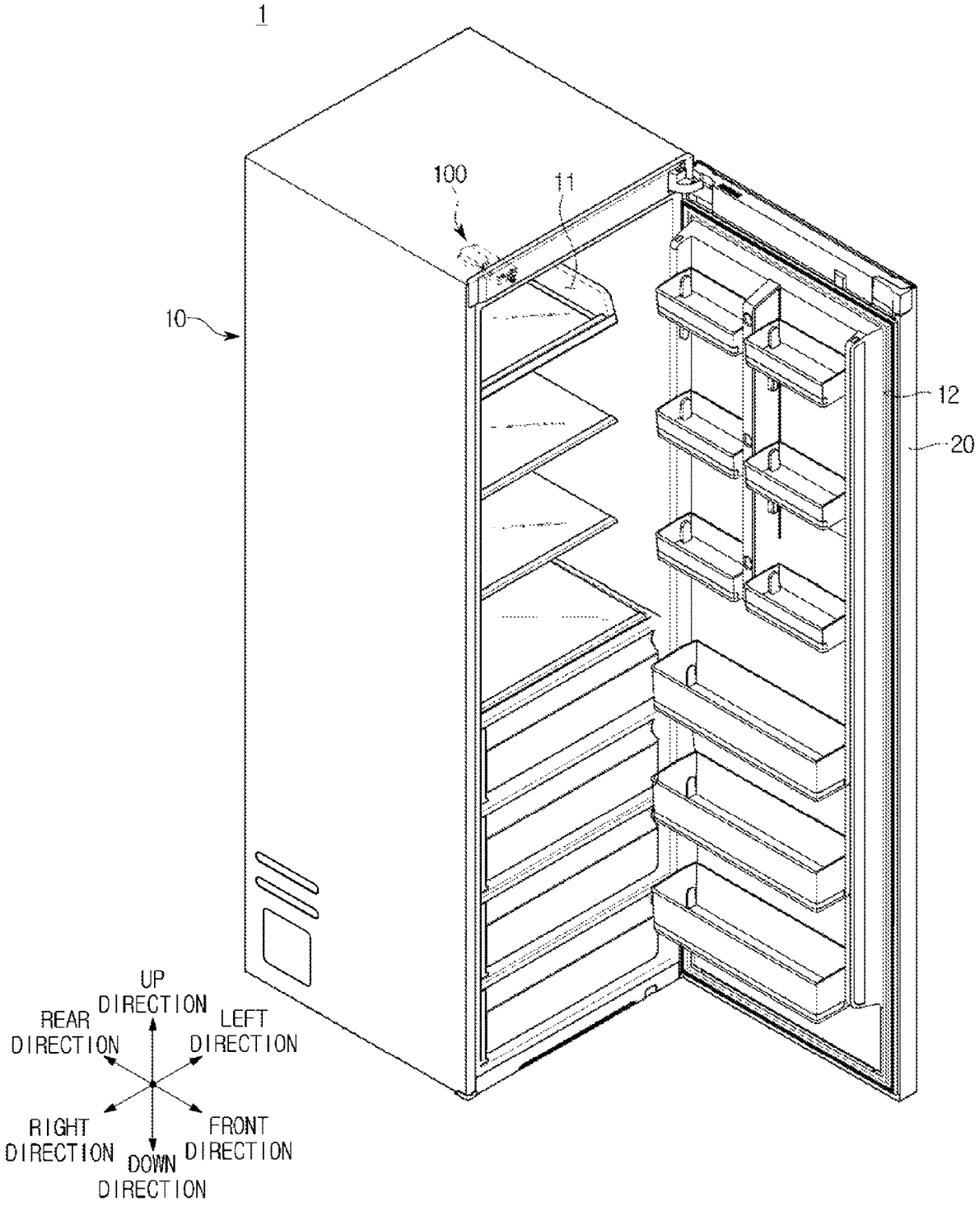
FIG. 3 shows the refrigerator shown in FIG. 2, when the door is in an open state.

FIG. 2 shows an outer appearance of a refrigerator including a door opening apparatus according to an embodiment, when a door is in a closed state, and FIG. 3 shows the refrigerator shown in FIG. 2, when the door is in an open state.

The refrigerator 1 may include a main body 10 including a storage room 11, the door 20 disposed on a front side of the storage room 11 to open or close the storage room 11, and the door opening apparatus 100 for opening the door 20 automatically.

The refrigerator 1 may include a single storage room 11. The storage room 11 may be used as a refrigerating room or a freezing room, wherein temperature of the storage room 11 may be adjusted.

Meanwhile, the storage room 11 or the door 20 may be provided in different numbers although not shown in the drawings. For example, the refrigerator 1 may include two storage rooms aligned vertically, and may be a Bottom Mounted Freezer (BMF) type in which a freezing room is disposed below a refrigerating room, or a Top Mounted Freezer (TMF) type in which a freezing room is disposed above a refrigerating room. Also, the refrigerator 1 may be a Side By Side (SBS) type in which two storage rooms are disposed side by side.

The door 20 may be rotatable with respect to the main body 10. However, the door 20 may be a drawer type door that can move forward or backward with reference to the main body 10. According to a technical concept of the present disclosure, the kind of the door 20 is not limited.

The door opening apparatus 100 may be disposed at the top of the main body 10. When a portion of a front surface of the door 20 is pressed in the rear direction by a user (that is, when push pressure is applied), the door opening apparatus 100 may open the door in the front direction.

Also, the door opening apparatus 100 may sense an external impact applied on the door 20, and distinguish the external impact from push pressure applied by the user.

More specifically, the push pressure may be a force applied in a direction of pushing the door 20 in the rear direction of the refrigerator 1 in order for a user to open the door 20 of the refrigerator 1, and the external impact may be various forces or vibrations applied on the main body 10 or the door 20 except for a force applied in the direction of pushing the door 20. For example, if the refrigerator 1 is a SBS type including two storage rooms and two doors, the external impact may be push pressure applied on a door disposed to the side. If the refrigerator 1 is a BMF or TMP type including two storage rooms disposed vertically and a single door, the external impact may be a force applied on the main door 10 except for the door 20. However, there may be various external impacts, and the external impact is not limited to a specific force.

If an external impact is applied, the door opening apparatus 100 may maintain the door 20 in a closed state, without opening the door 20. The operation will be described later.

Meanwhile, the door opening apparatus 100 may be disposed at a bottom of the main body 10. Also, a plurality of door opening apparatuses 100 may be provided according to the type of the refrigerator 1. For example, a plurality of door opening apparatuses 100 may be provided to correspond to the number of doors. That is, the number and arrangement of the door opening apparatus 100 may depend on the type of the refrigerator 1, the number of doors, and a design specification.

Figure 4:
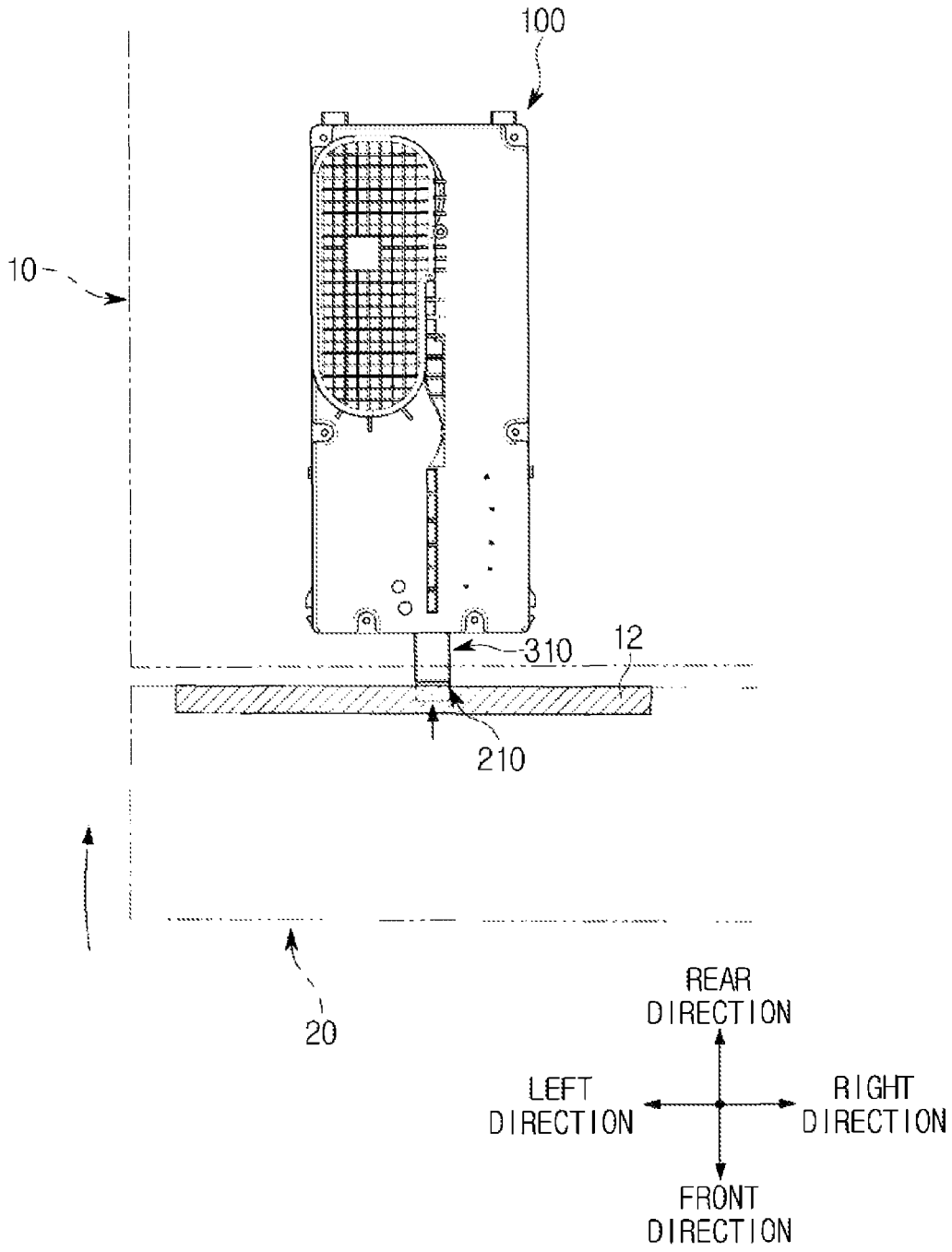
FIGS. 4 and 5 show an operation of a door opening apparatus according to an embodiment.
Figure 5:
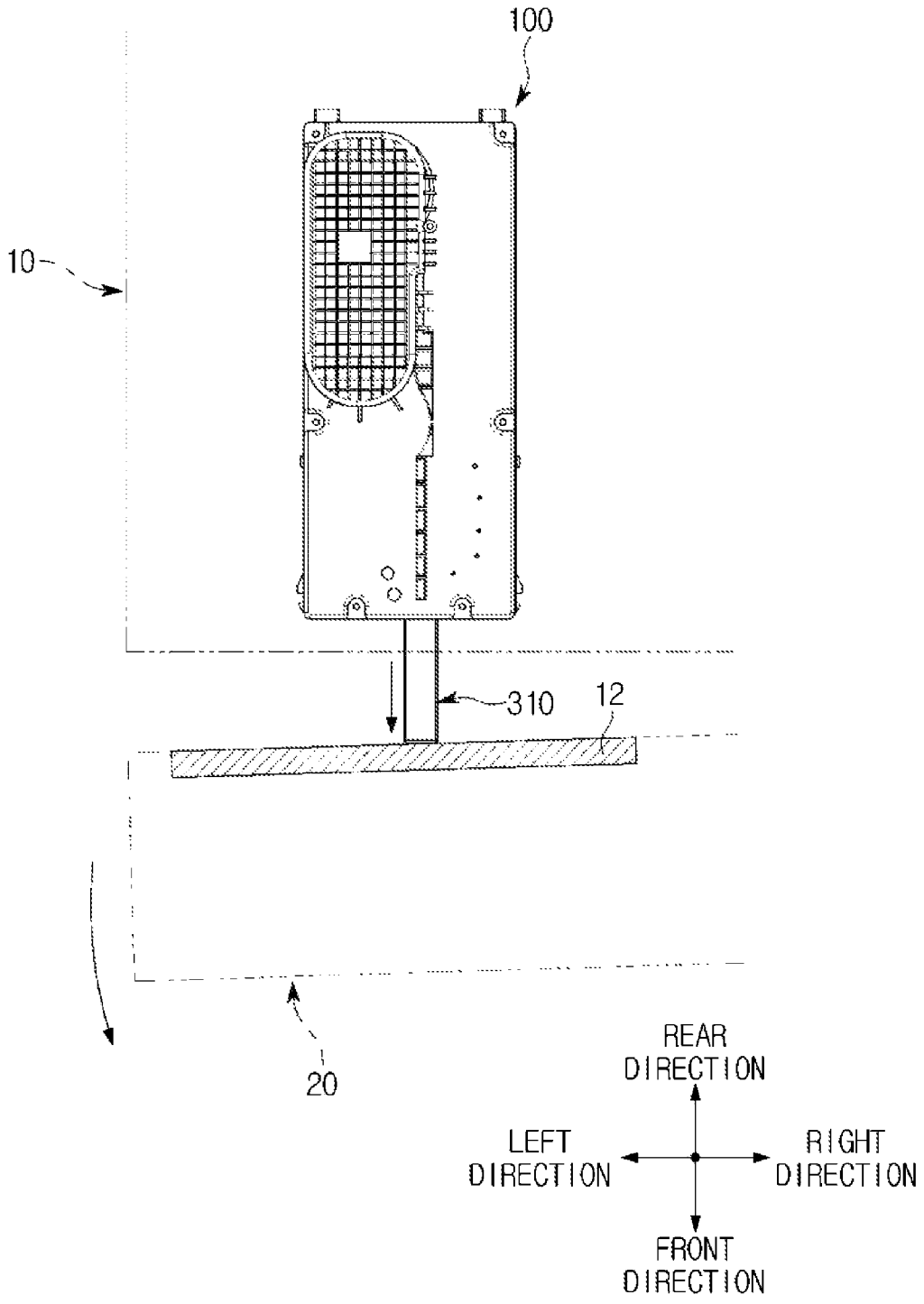

FIGS. 4 and 5 show an operation of a door opening apparatus according to an embodiment.

When the door 20 is in a closed state, a user may push an arbitrary side of the door 20 to move the door 20 in the rear direction.

A gasket 12 may be disposed between the door 20 and the main body 10. The gasket 12 may seal off a gap between the door 20 and the main body 10, and be positioned along edges of the door 20. Also, the gasket 12 may be made of a rubber material having elasticity, and vibrate according to a user's push pressure or an external impact.

If a user applies push pressure on the door 20, the gasket 12 and the door 20 may move slightly in the rear direction.

When the door 20 moves in the rear direction, the sensing lever 210, which is in contact with the gasket 12, may move in the rear direction together with the gasket 12.

If the door 20 moves in the rear direction so that the sensing lever 210 moves to the inside of the door opening apparatus 100, the controller 400 may move the push lever 310 in the front direction to open the door 20.

The push lever 310 may receive a driving force from the driving motor 320 which will be described later to push the door 20 in the front direction. The door 20 may be opened automatically by the push lever 310. The push lever 310 may open the door 20, and then be inserted into its original position by the driving motor 320. That is, the push lever 310 may move in the front direction to open the door 20, and then move in the rear direction to return to the original position.

Thereby, the door opening apparatus 100 may include no separate switch installed in the main body 10 or the door 20. Accordingly, the door opening apparatus 100 may separate the door 20 from the main body 10 without fully opening the door 20 to enable a user to easily open the door 20 with a small force.

Figure 6A:
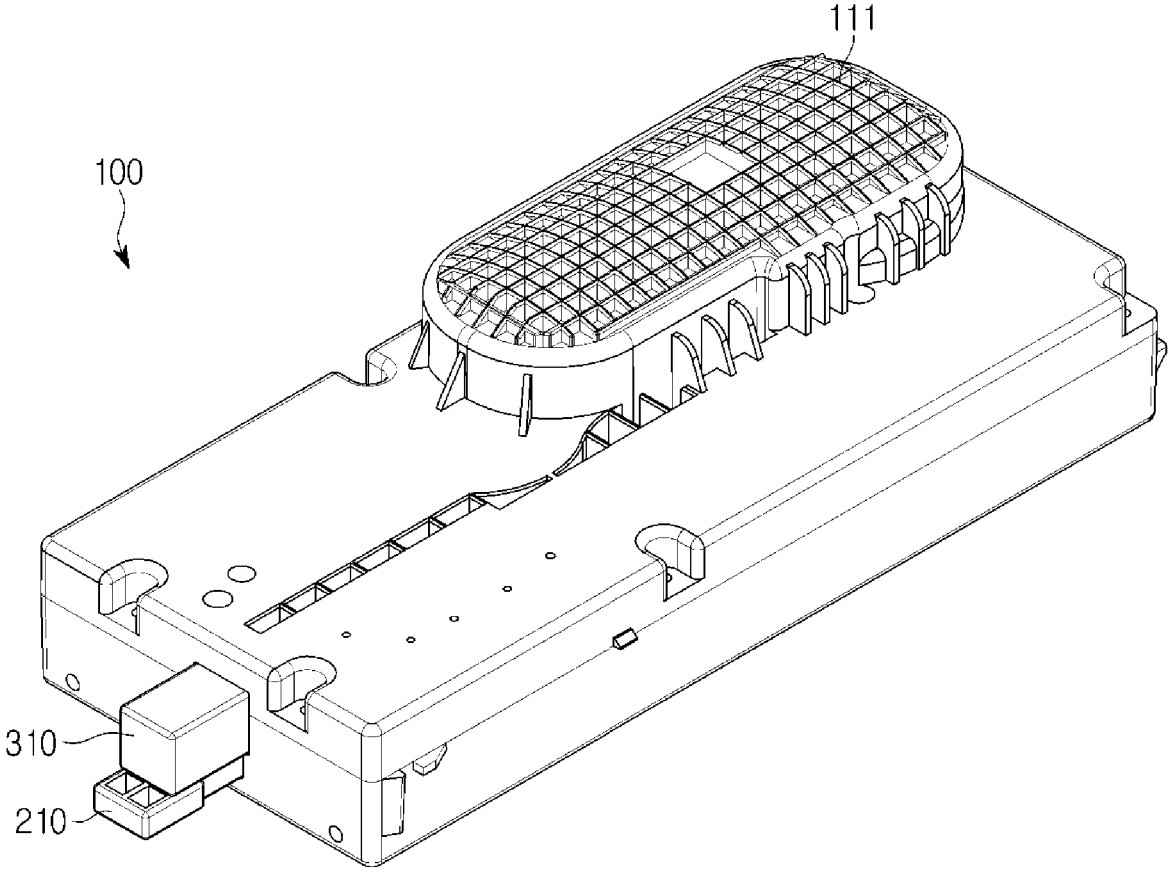
FIG. 6A is a perspective view showing an outer appearance of a door opening apparatus according to an embodiment.
Figure 6B:
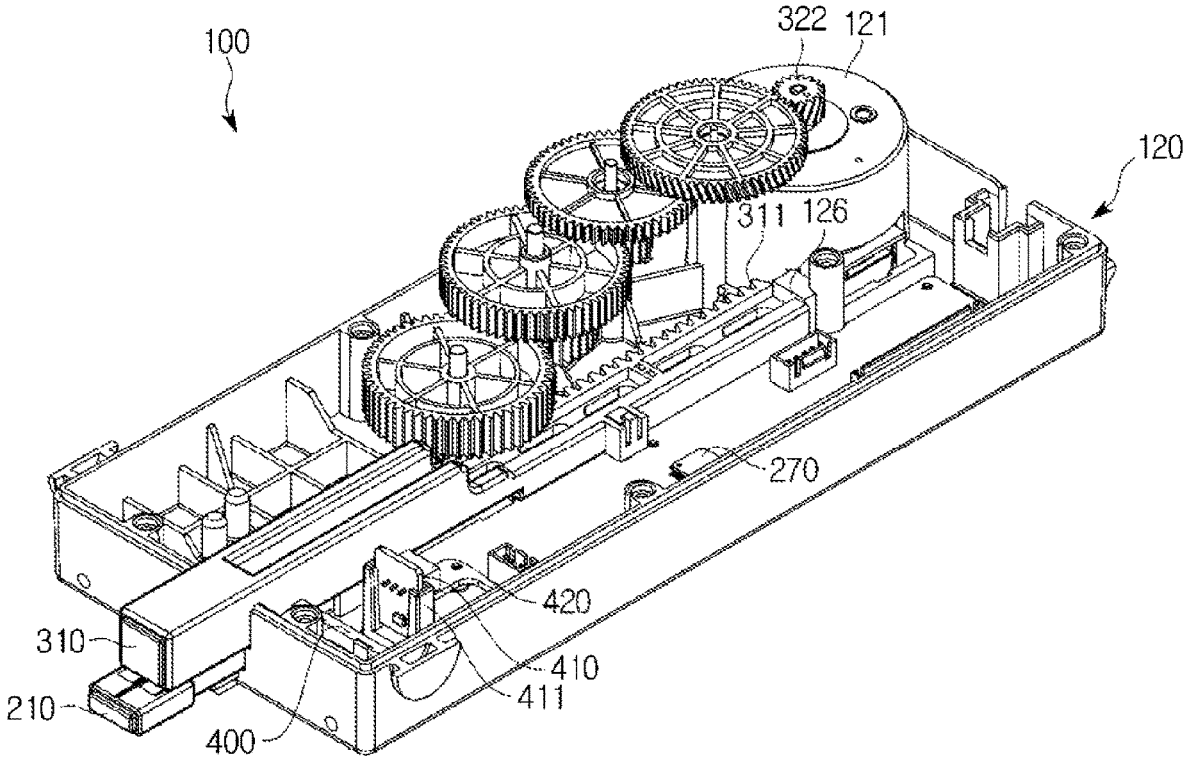
FIG. 6B is a perspective view of the door opening apparatus shown in FIG. 6A when a upper case of the door opening apparatus is removed.
Figure 7:
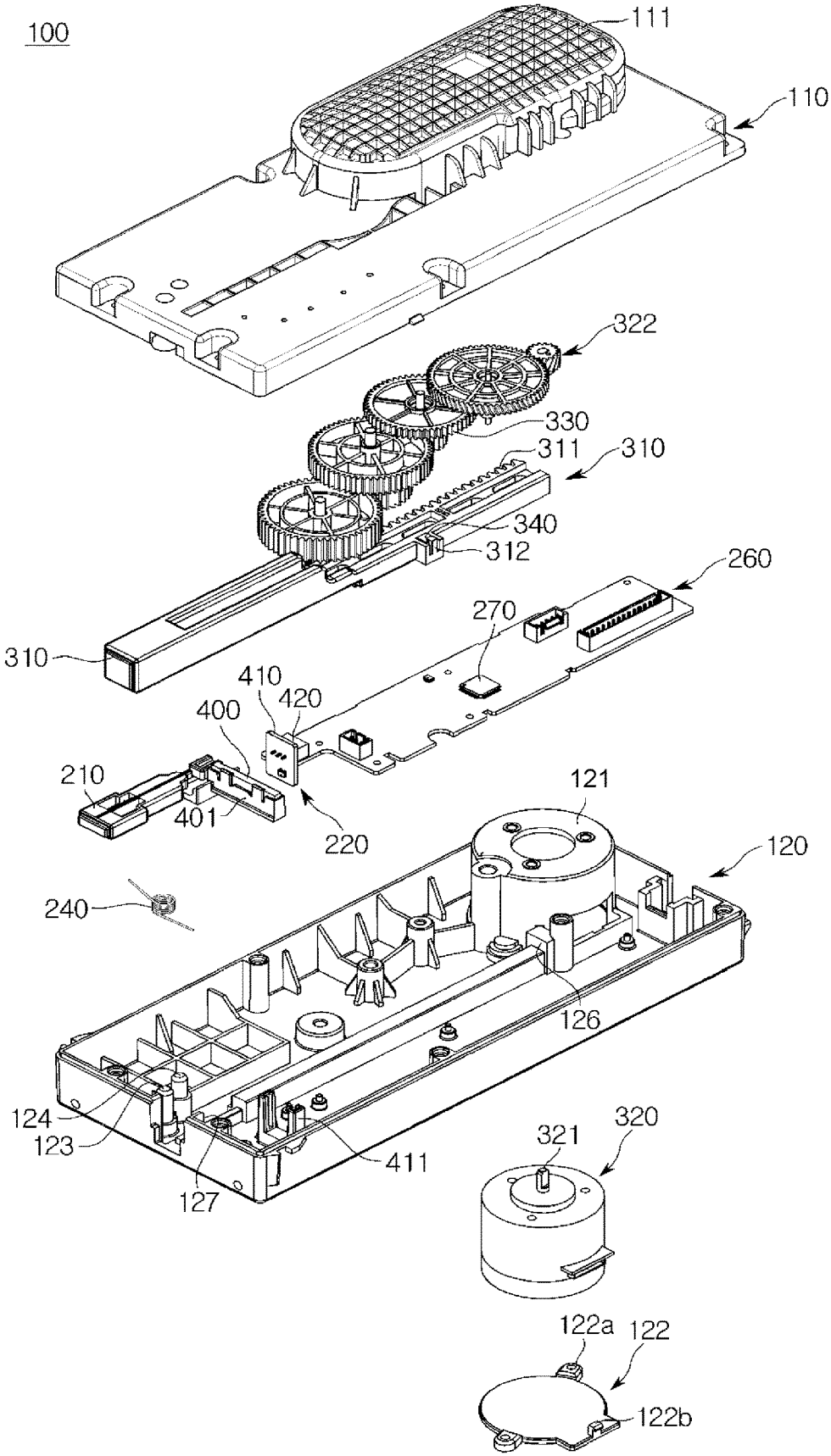
FIG. 7 is an exploded perspective view of the door opening apparatus shown in FIG. 6B.

FIG. 6A is a perspective view showing an outer appearance of a door opening apparatus according to an embodiment, FIG. 6B is a perspective view of the door opening apparatus shown in FIG. 6A when a upper case of the door opening apparatus is removed, and FIG. 7 is an exploded perspective view of the door opening apparatus shown in FIG. 6B.

Figure 8:
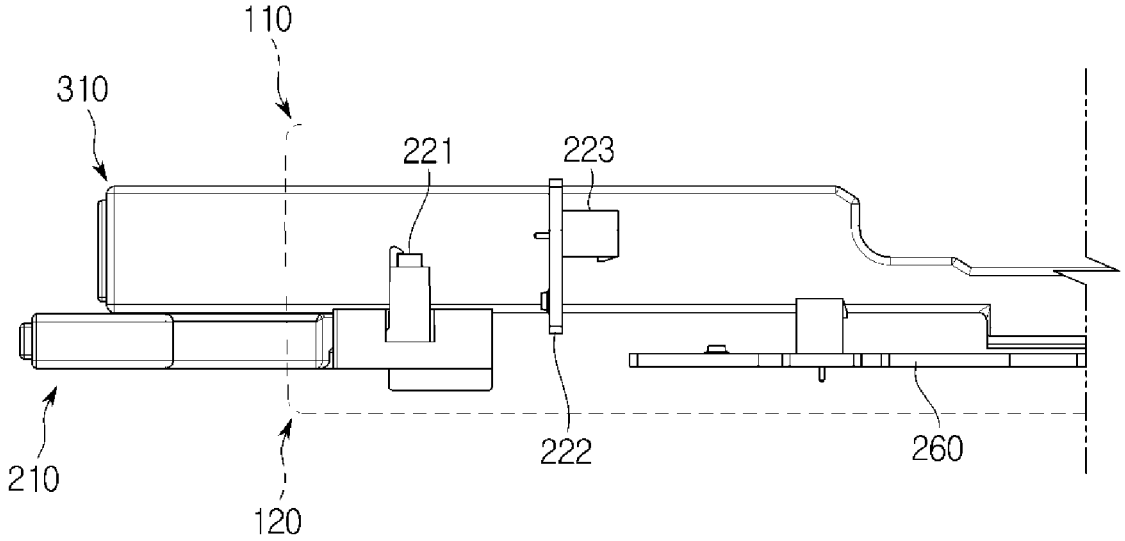
FIG. 8 shows the door opening apparatus shown in FIG. 6B at a different angle.

FIG. 8 shows the door opening apparatus shown in FIG. 6B at a different angle.

When the door 20 is pressed, the door opening apparatus 100 may sense a movement amount of the door 20 to open the door 20. The door opening apparatus 100 may need to determine whether a force applied on the door 20 is push pressure for opening the door 20 or an impact applied from the outside.

As described above, the gasket 12 may be made of a rubber material having elasticity. If push pressure is applied, the gasket 12 may move in the rear direction together with the door 20. However, since an external impact has no specific direction, the gasket 12 may vibrate momentarily in the front or rear direction by the external impact.

In this case, the sensing lever 210 which is in contact with the gasket 12 may move in the front direction together with the gasket 12. The sensing device 200 may sense the front direction in which the sensing lever 210 moves by the external impact, and distinguish the external impact from push pressure.

That is, the sensing lever 210 may move in the front or rear direction of the refrigerator 1 according to a movement of the gasket 12 vibrating on the door 20.

Meanwhile, the embodiment according to an aspect of the present disclosure is not limited to sensing the sensing lever 210 moving according to vibrations of the gasket 12. Although the elastic material of the gasket 12 absorbs an external impact well to enable the sensing device 200 to sense an external impact accurately, the sensing lever 210 may be in contact with the door 20, according to another embodiment. The other embodiment will be described in detail with reference to FIG. 15, later.

The sensing device 200 may include a magnet 221 connected to the sensing lever 210 to move in the front or rear direction together with the sensing lever 210. That is, when the sensing lever 210 moves in the rear direction by a user's push pressure, the magnet 221 may also move in the rear direction.

The sensor 220 may sense a movement amount of the magnet 221. For example, the sensor 220 may be a hall device 222 to detect a change in magnetic field according to a movement of the magnet 221. The hall device 222 may be manufactured as a thin semiconductor, and examples of the hall device 222 may include Indium-Arsenide (InAs), Indium-Antimonide (InSb), etc.

The hall device 222 may detect a magnetic field changing by the magnet 221 as a voltage value. The voltage value detected by the hall device 222 may be transferred to a microchip 270 mounted on a Printed Circuit Board (PCB) via a jack 223.

The microchip 270 may include a processor for implementing the controller 400, etc. That is, the microchip 270 may function as the controller 400.

The controller 400 may determine a movement direction of the sensing lever 210 based on a voltage value detected by the hall device 222.

If the sensing lever 210 moves in the rear direction, the controller 400 may drive the operator 300 to open the door 20. A criterion based on which the controller 400 determines whether to open the door 20 may be a movement amount of the sensing lever 210.

Meanwhile, the controller 400 may determine whether the sensing lever 210 has moved in the front direction, based on the voltage value. If the sensing lever 210 moves in the front direction and then in the rear direction, the controller 400 may not drive the operator 300. The operation will be described in detail with reference to FIG. 9A, later.

As shown in FIG. 7, the operator 300 may include a driving motor 320 for providing a driving force, and a push lever 310 for receiving a driving force from the driving motor 320 to push the door 20.

The driving motor 320 may operate by the controller 400. As described above, when a user pushes the door 20, the sensing device 200 may sense the push pressure through a movement of the sensing lever 210, and if the sensing device 200 transfers a sensing signal corresponding to the push pressure to the controller 400, the controller 400 may operate the driving motor 320.

The driving motor 320 may include a driving shaft 321, and a driving gear 322 may be coupled with the driving shaft 321.

The driving motor 320 may rotate forward to move the push lever 310 in the front direction. Also, the driving motor 320 may rotate backward to move the push lever 310 in the rear direction.

The push lever 310 may move linearly. The push lever 310 may be connected to the driving motor 320, and receive a driving force from the driving motor 320 to push the door 20. The push lever 20 may move forward to contact the door 20, and then separate the door 20 from the main body 10 in a direction in which the door 20 opens. The push lever 310 may move forward to open the door 20, and then move in the rear direction by the driving motor 320 to return to the original position.

The push lever 310 may include a rack gear portion 311. The rack gear portion 311 may be directly connected to the driving motor 320 to convert rotation displacement of the driving motor 320 to linear displacement. The driving gear 322 may function as a pinion gear. Unlike this, as shown in FIG. 7, the rack gear portion 311 may be connected to a deceleration gear 330. The deceleration gear 330 may be disposed between the rack gear portion 311 of the push lever 310 and the driving gear 322 of the driving motor 320 to amplify a driving force of the driving motor 320.

The operator 300 may further include the deceleration gear 330 for reducing rotation displacement of the driving motor 320. The deceleration gear 330 may amplify a driving force of the driving motor 320, while reducing rotation displacement of the driving motor 320. The deceleration gear 330 may be disposed between the rack gear portion 311 of the push lever 310 and the driving gear 322 of the driving motor 320.

The deceleration gear 330 may include a large-diameter portion (not shown) and a small-diameter portion (not shown) whose rotation axis is identical to that of the large-diameter portion. The diameter of the small-diameter portion may be smaller than that of the large-diameter portion. Gear teeth formed along the outer circumference of the small-diameter portion may be arranged at the same intervals as gear teeth formed along the outer circumference of the large-diameter portion.

The large-diameter portion of the deceleration portion 330 may be engaged with the driving gear 322. The small-diameter portion of the deceleration portion 330 may be engaged with the rack gear portion 311 of the push lever 310. The small-diameter portion of the deceleration gear 330 may function as a pinion gear to convert rotation displacement of the driving gear 322 to linear displacement of the push lever 310.

The deceleration gear 330 may be provided to amplify an output of the driving motor 320 while reducing displacement of the driving motor 320. Also, a plurality of deceleration gears 330 may be provided.

The operator 300 may include a magnet (not shown) for sensing a movement amount of the push lever 310 and a hall device (not shown) for sensing a magnetic field of the magnet. The controller 400 may control a degree of opening of the door 20 based on a movement amount of the push lever 310 transferred from the hall device.

The door opening apparatus 100 may include an upper case 110 and a lower case 120 forming an outer appearance of the door opening apparatus 100 and accommodating the sensing device 200 and the operator 300.

The upper case 110 may include a noise reducer 111 in which at least a part of the deceleration gear 330 and the driving motor 320 is accommodated. The noise reducer 111 may reduce noise caused by the driving motor 320.

The noise reducer 111 may include a rib formed in the shape of a waffle to reduce noise and vibrations generated from the driving motor 320.

The lower case 120 may include a driving motor installing portion 121 in which the driving motor 320 is installed, and a driving motor fixing member 122 disposed below the driving motor 320 to fix the driving motor 320 in the driving motor installing portion 121.

By inserting the driving motor 320 into the driving motor installing portion 121, and then coupling the driving motor fixing member 122 with the driving motor 320 and the driving motor installing portion 121, the driving motor 320 may be installed in the lower case 120. At this time, a coupling portion 122*a* and a coupling protrusion 122*b* formed in the driving motor fixing member 122 may be used.

The lower case 120 may include a first fixing pin 123 for fixing one end of a first elastic member 240, and a second fixing pin 124 for fixing another end of the first elastic member 240. The first and second fixing pins 123 and 124 will be described with reference to FIG. 11, later.

Figure 9A:
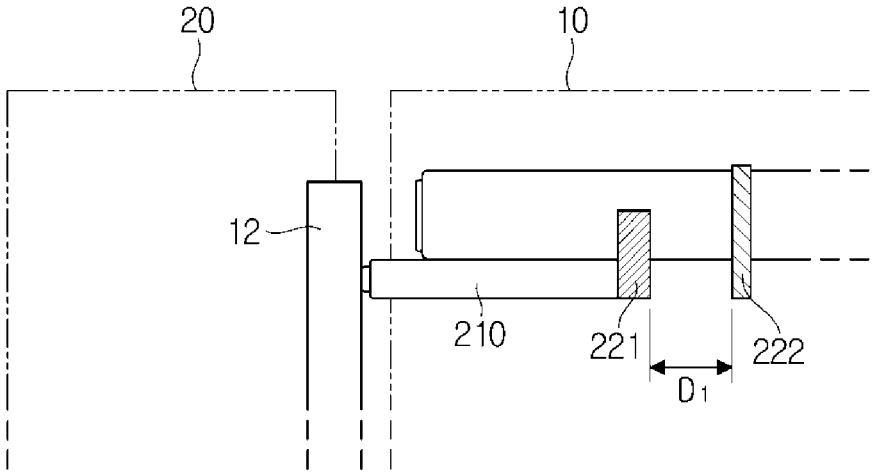
FIGS. 9A, 9B and 9C are views for describing an operation of a sensing device according to an embodiment.
Figure 9B:
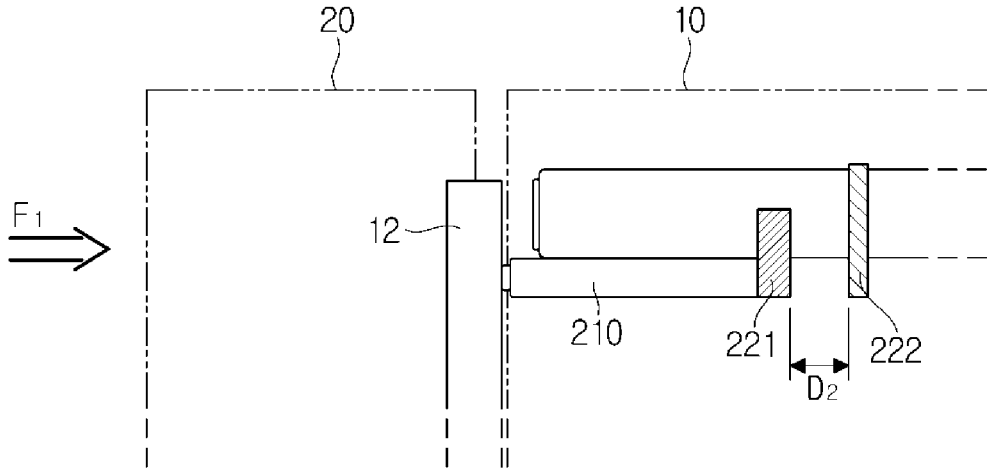

FIGS. 9A and 9B are views for describing an operation of a sensing device according to an embodiment. FIGS. 9A and 9B will be referred to together in order to avoid duplication of description.

Referring to FIG. 9A, when the door 20 is in a closed state, the sensing lever 210 may be in contact with the gasket 12 disposed on the door 20. The magnet 221 disposed on one end of the sensing lever 210 may be spaced by a predetermined distance D1 from the hall device 222.

If a user applies a push input F1 for opening the door 20, the door 20 and the gasket 12 may move the sensing lever 210 in a first direction. The first direction may be the rear direction as described above with reference to FIG. 2.

Referring to FIG. 9B, the magnet 221 may be provided together with the sensing lever 210, and move in the first direction. If the magnet 221 moves, a distance D2 between the magnet 221 and the hall device 222 may become shorter than the distance D1 between the magnet 221 and the hall device 222 when the door 20 is in the closed state (closed).

A magnetic field may change by the shortened distance D2, and the hall device 222 may detect a changed voltage and transfer it to the controller 400.

Meanwhile, the door 20 may receive various external impacts F2 other than the push input F1. As described above, the external impacts may be vibrations transferred from the main body 10, or a force such as a push input transferred from another door if the refrigerator 1 includes a plurality of doors.

Figure 9C:
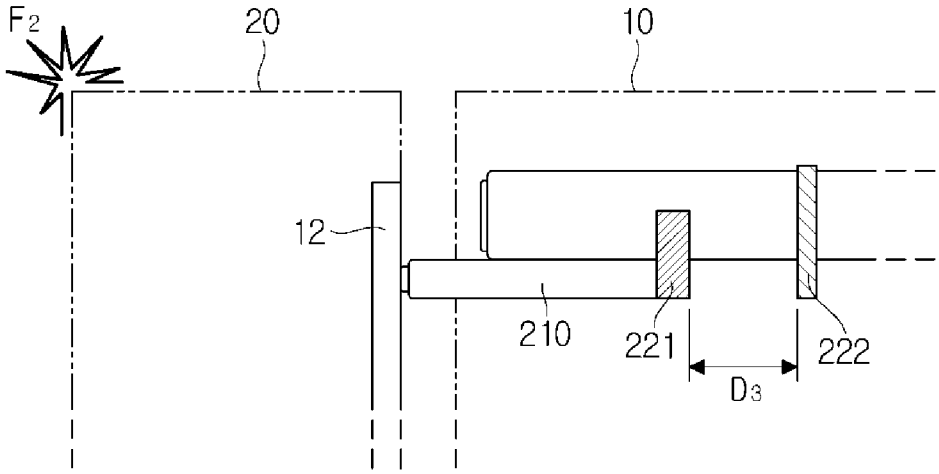

As shown in FIG. 9C, if an external impact F2 is applied, the door 20 may vibrate, and the gasket 12 may vibrate slightly by an elastic force. The sensing lever 210 may move momentarily in a second direction due to the movement of the gasket. Herein, the second direction may be the front direction shown in FIG. 2.

If the sensing lever 210 moves in the second direction, the magnet 221 may also move in the second direction together with the sensing lever 210, so that a distance D3 to the hall device 222 may increase. The hall device 222 may detect a magnetic field changing according to the increased distance D3, and transfer a voltage value of the magnetic field to the controller 400.

The controller 400 may determine whether to drive the operator 300 of the door 20, based on the changed voltage value. A criterion based on which the controller 400 determines whether to drive the operator 300 of the door 20 will be described with reference to the following drawings, later.

Meanwhile, FIGS. 9A to 9C relate to an example in which when the sensing lever 210 in contact with the gasket 12 moves, the magnet 221 connected to the sensing lever 210 moves together. However, the embodiment of the present disclosure is not limited to the example.

More specifically, the magnet 221 may be separated from the sensing lever 210, and disposed separately in the inside of the door opening apparatus 100. In this case, the hall device 222 may be disposed at one end of the sensing lever 210. When the sensing lever 210 moves by vibrations of the gasket 12, the hall device 222 may move together.

The hall device 222 may move together with the sensing lever 210, and a distance between the hall device 222 and the fixed magnet 221 may change according to an external impact and push pressure. As the distance between the hall device 222 and the magnet 221 changes, the magnetic field may change together, and the hall device 222 may determine a movement direction of the sensing lever 210 based on intensity of the magnetic field.

Figure 10A:
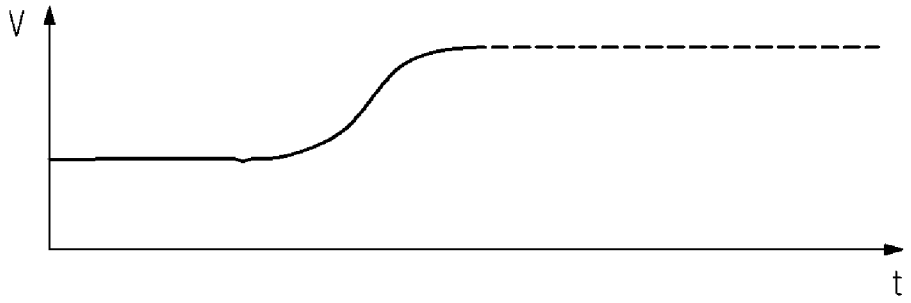
FIGS. 10A and 10B are graphs for describing the results of detection by the sensing device.
Figure 10B:
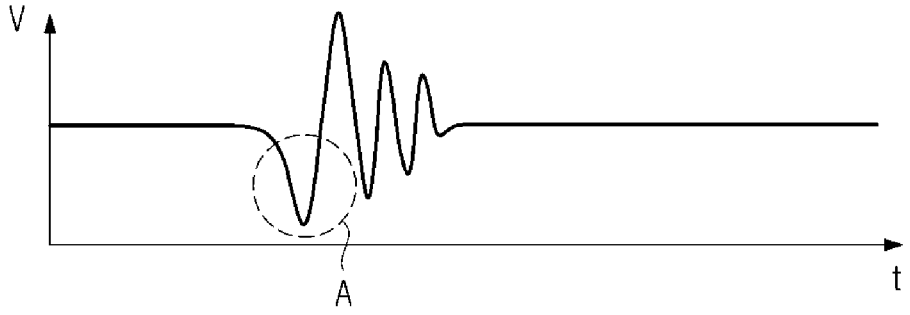

FIGS. 10A and 10B are graphs for describing the results of detection by the sensing device.

In the graphs of FIGS. 10A and 10B, the X axis represents time, and the Y axis represents the results (that is, voltage values) of detection by the hall sensor 222.

FIG. 10A shows the result of detection by the hall device 222 when a user applies a push input F1 on the door 20, and FIG. 10B shows the result of detection by the hall device 111 when a user applies an external impact F2 on the door 20.

When the door 20 is pressed, a voltage value detected by the hall device 222 according to a distance shortened in the rear direction by a movement of the sensing lever 210 may raise in a predetermined direction as shown in FIG. 10A. A magnitude of the increased voltage may be not necessarily constant. In the graph of FIG. 10A, a dotted line represents that the magnitude of the voltage is not constant.

If the voltage value increases in the predetermined direction, and the increased voltage exceeds a predetermined magnitude, that is, a setting value, the controller 400 may determine that there is a user's push input F1, and drive the operator 300.

According to an example, a criterion for opening the door 20 may be a change in voltage of 1V or more.

When an external impact F2 is applied, a voltage value detected by the hall device 222 may have an opposite direction as shown in FIG. 10B. That is, unlike FIG. 10A, when an external impact F2 is applied, the hall device 222 may detect a voltage value that is different from a reference voltage value which it detects when the door 20 is in a closed state and a voltage value which it detects when the push input F1 is applied.

A section A in which the voltage changes in the opposite direction may be detected when the gasket 12 moves the sensing lever 210 slightly in the second direction. If the section A is detected, the controller 400 may determine that an applied input is not a user's push input F1, and may not drive the operator 300.

Meanwhile, the section A may be detected several times by an external impact, as shown in FIG. 10B. The controller 400 may determine whether to control the operator 300, based on a detection value sensed when the sensing lever 210 moves in the second direction.

That is, the door opening apparatus 100 according to an aspect may determine whether an input is an input for opening the door 20, based on a movement amount of the sensing lever 210 moving in the first direction and in the second direction, to thereby prevent the door 20 from opening wrongly and to increase a user's convenience.

Also, when the sensing device 200 is constituted using a hall effect, the sensing device 200 may detect a movement amount of 0.6 mm of the sensing lever 210 moving according to vibrations of the gasket 12 caused by an external impact, resulting in an improvement of accuracy of a door opening operation.

Figure 11:
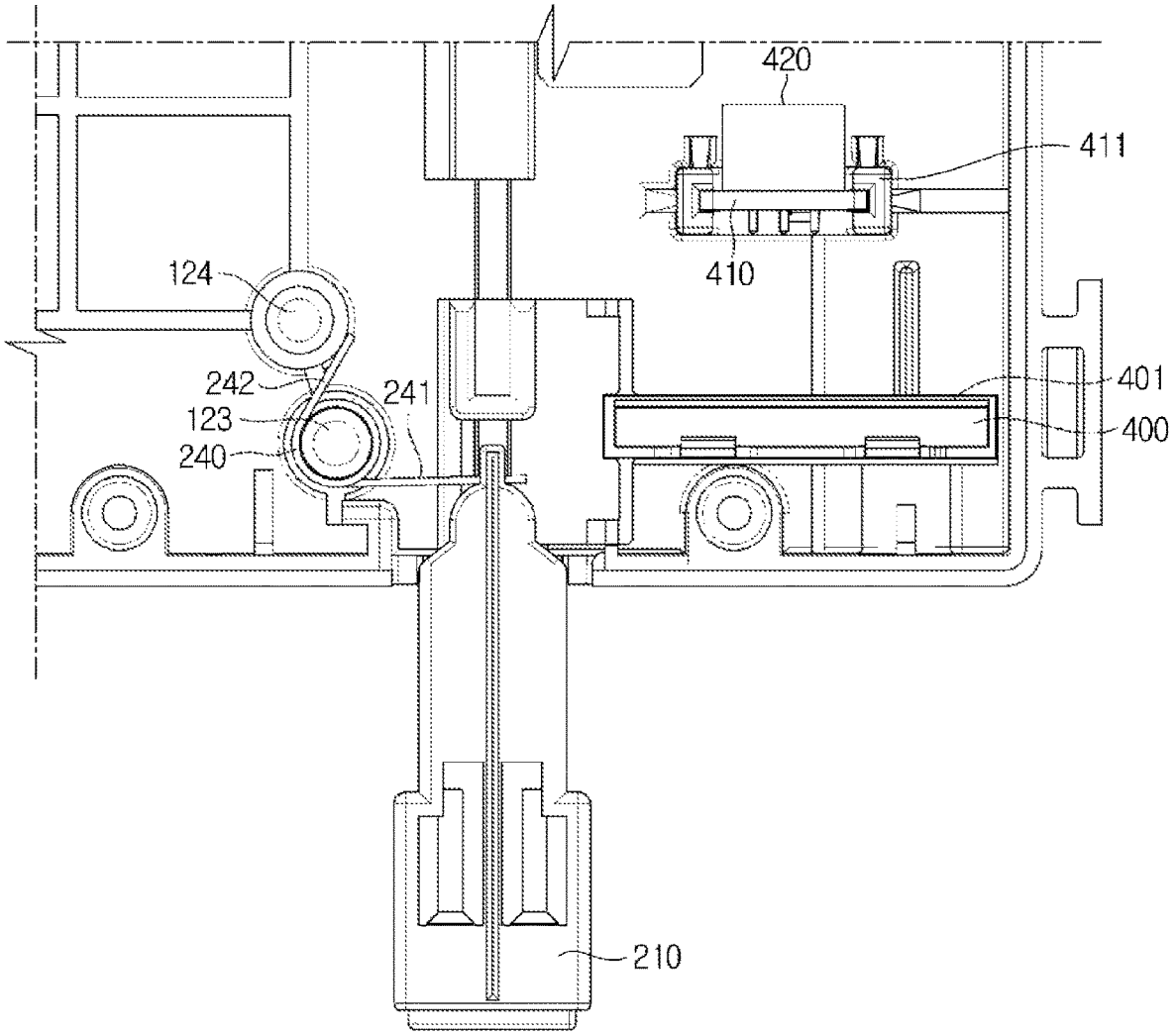
FIGS. 11 to 13 are views for describing an operation of a sensing lever according to an embodiment.
Figure 12:
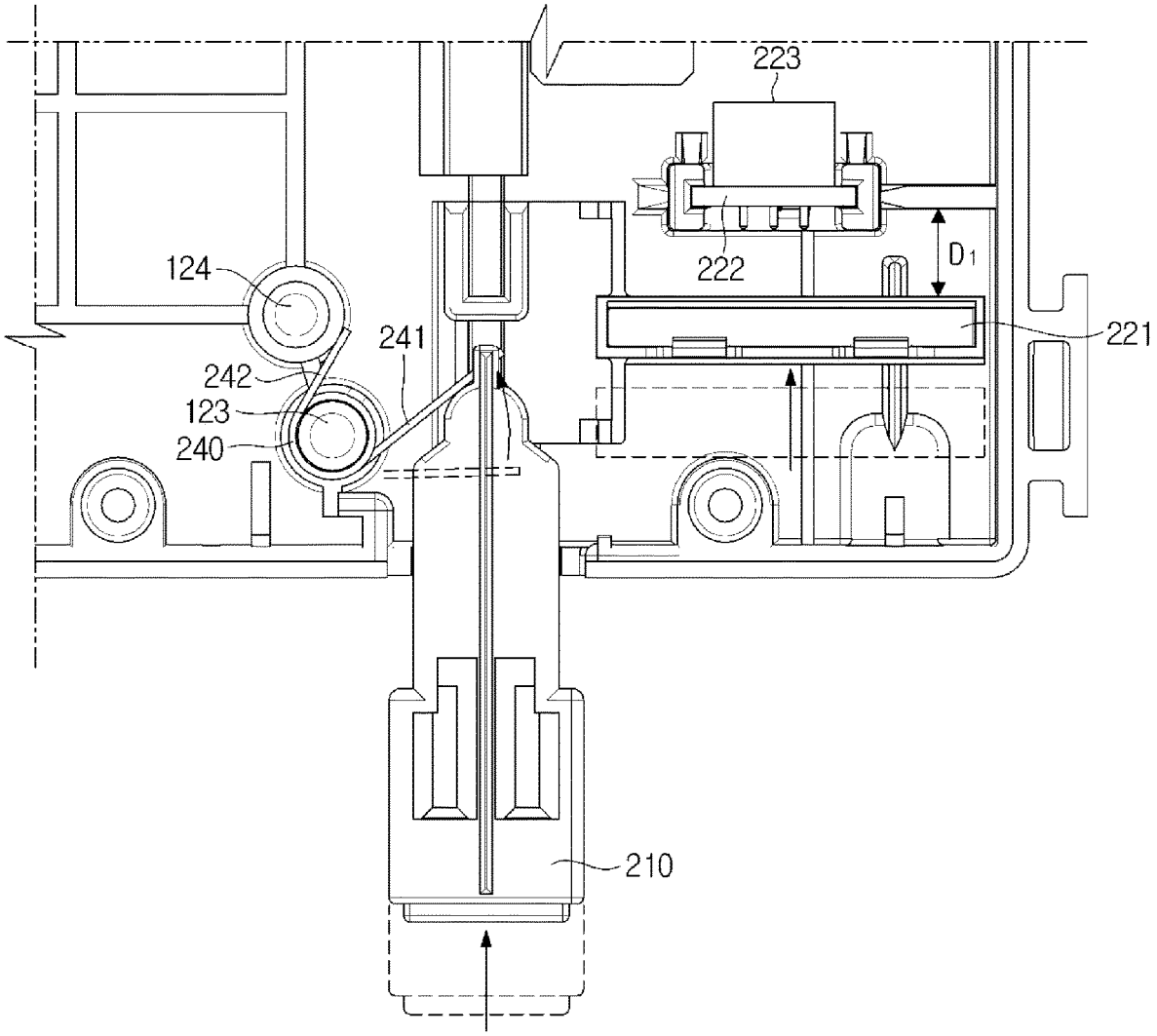
Figure 13:
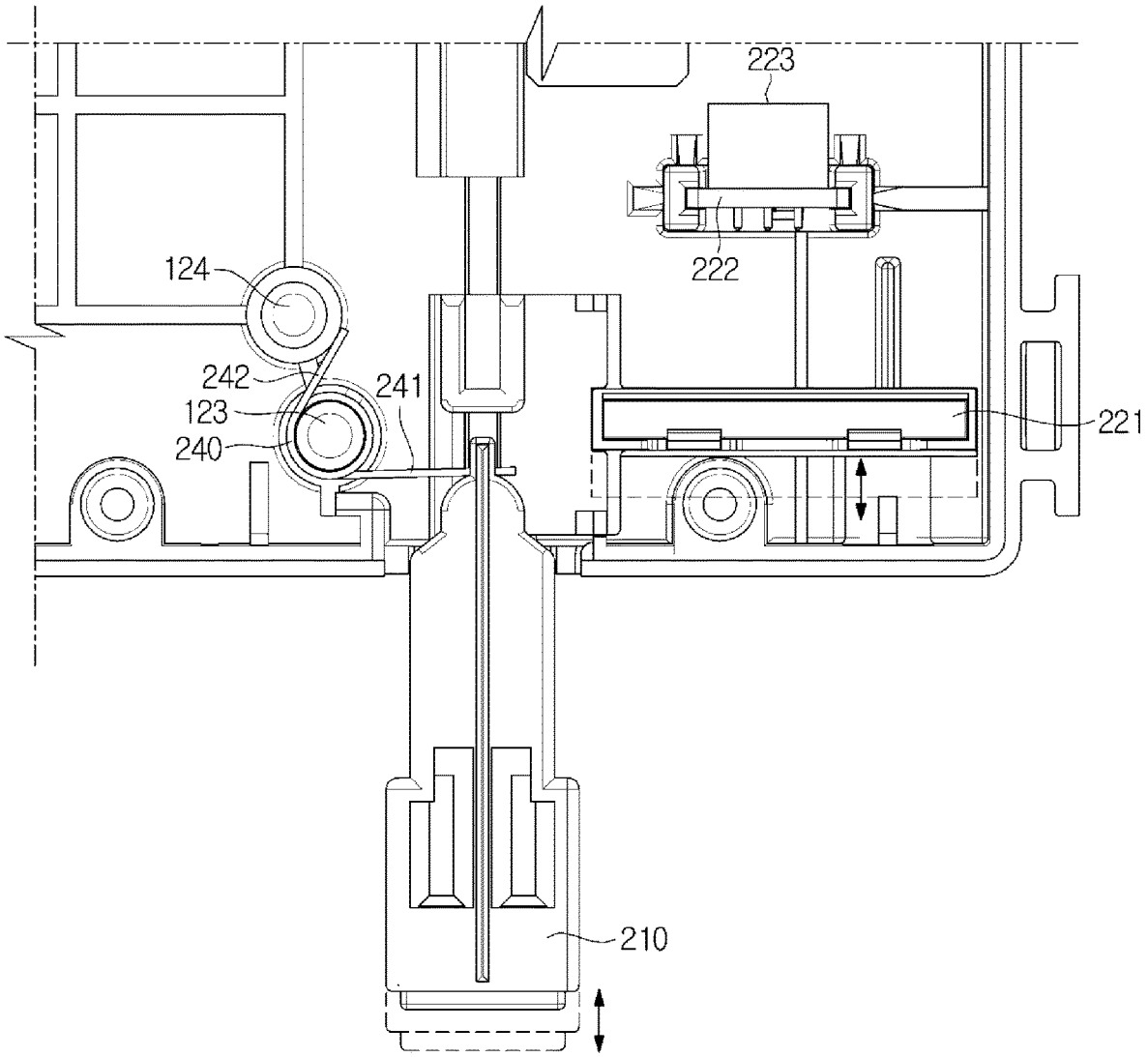

FIGS. 11 to 13 are views for describing an operation of a sensing lever according to an embodiment.

As described above, the sensing lever 210 according to an example may move forward or backward.

If the door 20 is opened and then closed, the sensing lever 210 may need to move to a reference position with respect to the door 20.

As described above with reference to FIG. 7, the lower case 120 may include the first fixing pin 123 and the second fixing pin 124, and the sensing module 200 may further include the first elastic member 240.

The first elastic member 240 may elastically bias the sensing lever 210 toward the door 20.

One end 241 and the other end 242 of the first elastic member 240 may be caught by one ends of the sensing lever 210 and the second fixing pin 124. The first elastic member 240 may be fixed at the first fixing pin 123. Through the structure, when the sensing lever 210 moves backward, the first elastic member 240 may accumulate an elastic force.

As shown in FIG. 12, when the sensing lever 210 moves backward by a push input applied on the door 20, the sensing lever 210 may move in the front direction by the elastic force of the first elastic member 240. Accordingly, after the sensing lever 210 moves in the rear direction, the sensing lever 210 may return to its original position by the elastic force.

However, as shown in FIG. 13, when the door 20 moves in the front direction by an external impact, the first elastic member 240 may have no influence on the operation of the sensing lever 210. That is, after the sensing lever 210 moves in the rear direction, the first elastic member 240 may move the sensing lever 210 to the reference position shown in FIG. 11.

Meanwhile, unlike the above description, according to another embodiment, the sensing device 200 may further include a gear (not shown) for elastically biasing the sensing lever 210 in the front direction, although not limited thereto.

Figure 14:
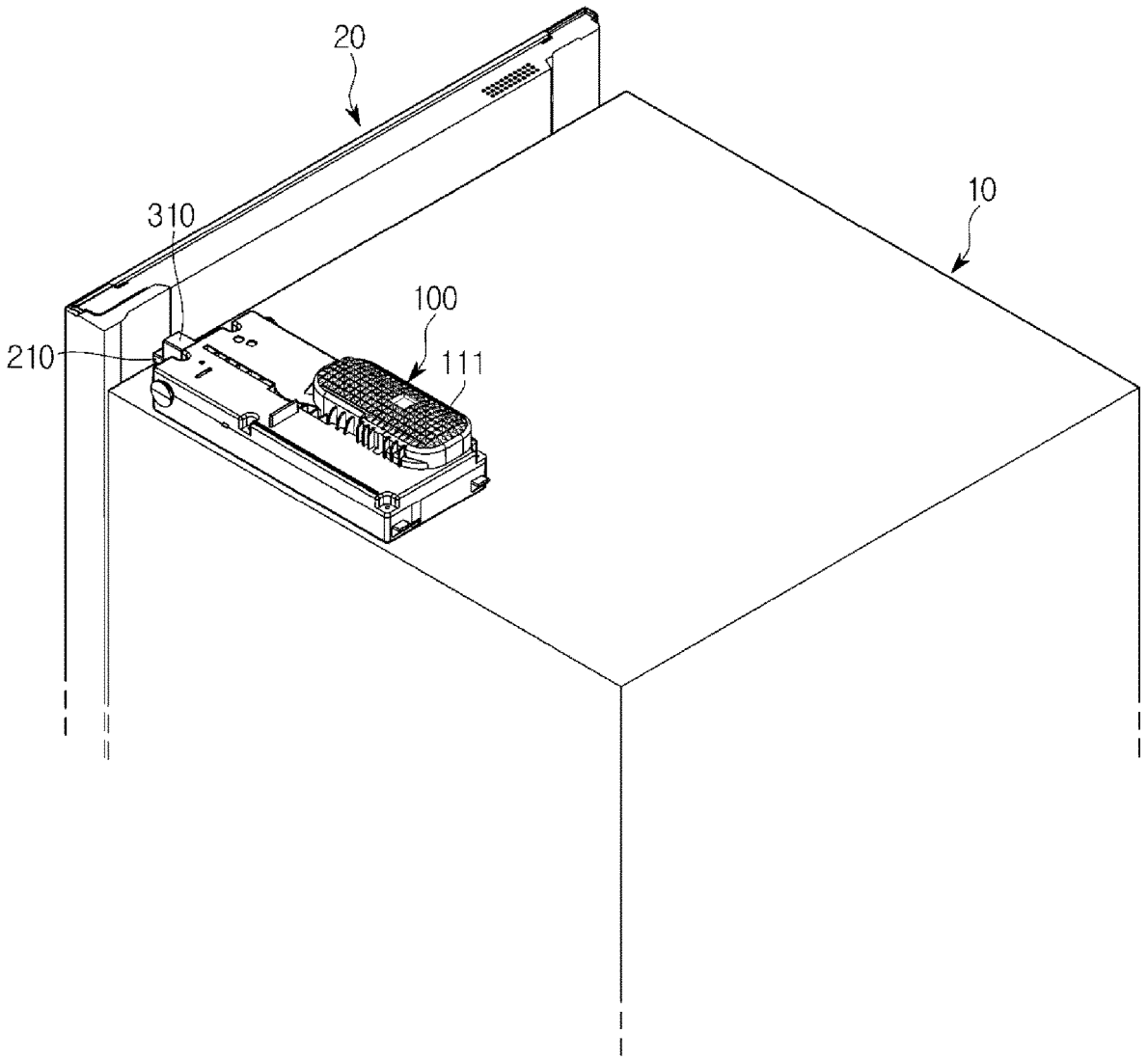
FIG. 14 shows a portion of a refrigerator according to another embodiment.

FIG. 14 shows a portion of a refrigerator according to another embodiment.

Referring to FIG. 14, the door opening apparatus 100 may be mounted on the top of the main body 10 of the refrigerator 2. In the refrigerator 1 according to the above-described embodiment, the door opening apparatus 100 may be disposed in the inside of the main body 10, that is, between the top of the storage room 11 and the outer plate of the main body 10. However, in the refrigerator 2 according to the other embodiment, the door opening apparatus 100 may be disposed on the top of the main body 10.

In this case, the sensing lever 210 included in the door opening apparatus 100 may contact a portion of the door 20 positioned higher than the main body 10. When the door 20 moves in a direction (that is, the first direction) from the door 20 to the main body 10 by a user's push pressure, the sensing lever 210 may also move in the first direction. In this case, the controller 400 may operate the push lever 310 in a direction (that is, the second direction) from the main body 10 to the door 20 to open the door 20.

Also, when the door 20 vibrates by an external impact, not push pressure, the sensing lever 20 may move slightly in the second direction. The sensor 220 included in the door opening apparatus 100 may sense the movement in second direction of the sensing lever 210. The controller 400 may determine that a current input force is not push pressure, based on the result of the sensing, and may not operate the push lever 310.

Meanwhile, the sensing device 200 of the door opening apparatus 100 shown in FIG. 14 may include the hall device 222 and the magnet 221. In this case, the magnet 221 may be installed in the inside of the door opening apparatus 100. However, the magnet 221 may be disposed at a portion of the door 20, and the hall device 222 may be installed in the inside of the door opening apparatus 100. This will be described in detail with reference to FIG. 15, later.

Figure 15:
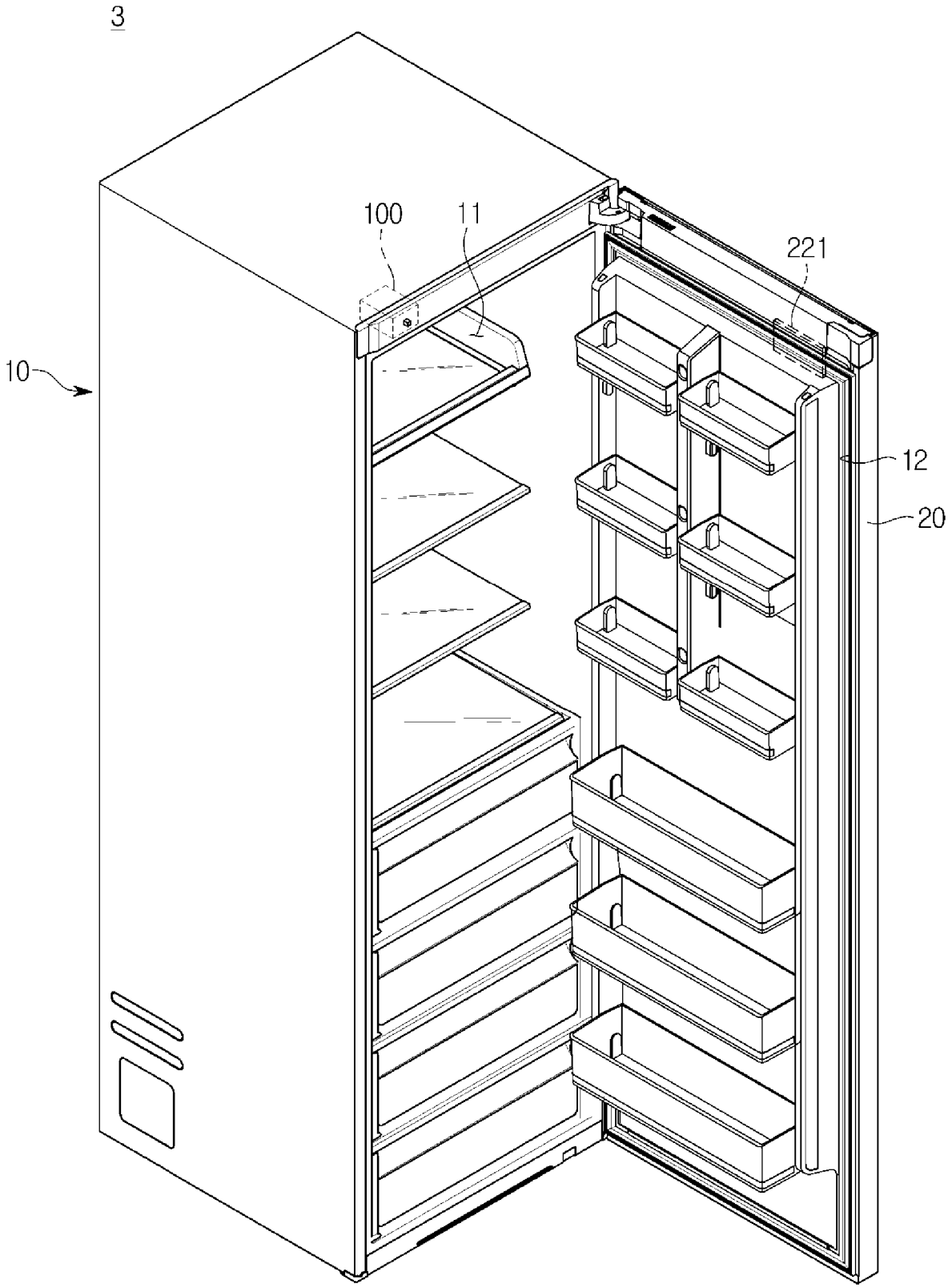
FIG. 15 shows a refrigerator according to another embodiment.

FIG. 15 shows a refrigerator according to another embodiment.

Referring to FIG. 15, in a refrigerator 3 according to another embodiment, a magnet 221 may be disposed at a portion of the door 20, and the sensing lever 210 and the hall device 222 may be installed in the inside of the door opening apparatus 100.

More specifically, the magnet 221 may be disposed on an inner surface of the door 20, and spaced by a predetermined distance from the sensing lever 210 contacting the gasket 12 or the door 20. When the door 20 or the gasket 12 vibrates by an external impact so that the sensing lever 210 moves in the direction (that is, the second direction) from the main body 10 to the door 20, the hall device 222 connected to the sensing lever 210 may move together with the sensing lever 210. As a result, a distance between the hall device 222 and the magnet 221 may change, and the controller 400 may determine a movement direction of the sensing lever 210, like the above-described embodiment.

Meanwhile, in FIG. 15, the magnet 221 may be installed in the inside of the door 20 to form an area of the door 20. That is, when the door 20 is in a closed state, the sensing lever 210, the gasket 12, and the magnet 221 may be arranged in this order. However, the magnet 221 may be disposed at any position at which it is spaced by a predetermined distance from the hall device 222 and installed in the door 20.

Figure 16:
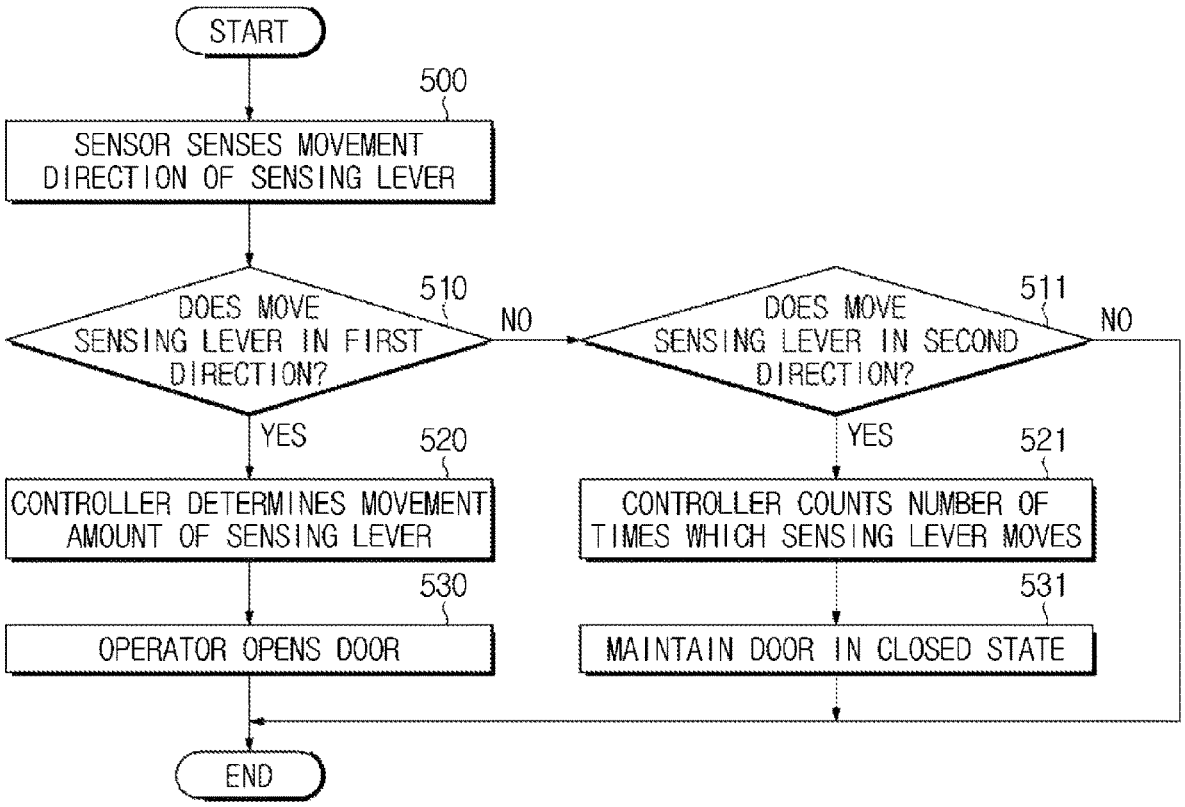
FIG. 16 is a flowchart for describing a method of controlling a refrigerator door.

FIG. 16 is a flowchart for describing a method of controlling a refrigerator door.

The sensing device 200 may sense a movement direction of the sensing lever 210, in operation 500.

There may be various methods in which the sensing device 200 senses a movement direction of the sensing lever 210. In the above description, a method in which the sensing device 200 detects a hall voltage changing according to a movement of the magnet 221 has been described as an embodiment. However, the sensing device 200 may be a mode switch. That is, the sensing device 200 may be any device that can determine a movement direction of the sensing lever 210.

The sensing device 200 may transfer a detection value for a movement direction of the sensing lever 210 to the controller 400.

The controller 400 may determine whether the movement direction of the sensing lever 210 is a first direction or a second direction, in operations 510 and 511.

According to an example, the first direction may be a direction in which the sensing lever 210 moves according to a user's force of pushing the door 20, that is, a user's push pressure. The second direction may be a direction in which the sensing lever 210 moves momentarily by another external force applied on the door 20, not push pressure, and the second direction may be opposite to the first direction.

If the sensing lever 210 moves in the first direction, the controller 400 may determine a movement amount of the sensing lever 210, in operation 520.

There may be various methods in which the controller 400 determines a movement amount of the sensing lever 210, according to the kind of the sensor 220. If the sensor 220 is a hall sensor, a detection value sensed by the sensing device 200 may include a time and magnitude of a hall voltage.

If the controller 400 determines that the sensing lever 200 has moved by a predetermined length in the first direction, the controller 400 may control the operator 300, in operation 530.

The operator 300 may operate the push lever 310 by the control of the controller 400 to open the door 20. There may be various methods in which the operator 300 opens the door 20, and all components described above with reference to FIG. 7 may be not necessarily included.

Meanwhile, if the movement direction of the sensing lever 210 is the second direction, the controller 200 may count the number of times which the sensing lever 210 moves in the second direction, in operation 521.

As described above with reference to FIG. 10B, if a hall voltage value is detected in the opposite direction, the controller 400 may determine that the door 20 has received an external impact.

Also, the controller 400 may use detection of the section A of FIG. 10B as a criterion for determining an external impact. That is, if the sensing lever 210 moves in the second direction according to vibrations of the gasket 12, a hall voltage value in a section having a detection value that is different from that of push pressure may be detected a predetermined number of times or more.

In this case, the controller 400 may maintain the door 20 in a closed state, in operation 531. That is, the controller 400 may not open the door 20 without controlling the operator 300.

Meanwhile, the predetermined number of times may change.

The embodiment related to the operation of the controller 400 may be implemented in the form of recording medium that stores commands executable by a computer. The commands may be stored in the form of program codes, and when executed by the processor, the commands may generate a program module to perform the operations of the disclosed embodiments. The recording medium may be implemented as computer-readable recording medium.

The computer-readable recording medium includes all kinds of recording media storing commands that can be decrypted by a computer. For example, the computer-readable recording medium may be Read Only Memory (ROM), Random Access Memory (RAM), a magnetic tape, a magnetic disk, flash memory, or an optical data storage device.

The refrigerator and the method of controlling the refrigerator door, according to an aspect, may enable a user to open the door automatically by pressing a portion of the door.

Also, the refrigerator and the method of controlling the refrigerator door, according to another aspect, may distinguish a user's push pressure from an external impact applied on the door to thereby improve the accuracy of a door opening operation and the user's convenience.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body having a storage room;

a door configured to open or close the storage room;

a sensing member configured to contact the door while the door is closed, the sensing member being movable in one of a first direction and in a second direction that is opposite to the first direction;

a sensor configured to sense a movement of the sensing member and whether the movement of the sensing member is in one of the first direction and the second direction; and a controller configured to control the door to be opened provided the movement of the sensing member sensed by the sensor is in the first direction, and to control the door to be maintained closed provided the movement of the sensing member sensed by the sensor is in the second direction.

2. The refrigerator according to claim 1, further comprising:

a gasket disposed on the door, the gasket being configured to seal off a gap between the door and the main body, wherein the sensing member contacts the gasket.

3. The refrigerator according to claim 2, wherein the controller maintains the door closed, when the sensing member moves in the second direction according to a vibration of the gasket.

4. The refrigerator according to claim 1, wherein the sensor comprises:

a magnet disposed at one end of the sensing member, the magnet being configured to be movable; and a hall device configured to sense a magnetic field change based on a movement direction of the magnet.

5. The refrigerator according to claim 3, wherein the controller determines whether the movement of the sensing member is in one of the first direction and the second direction based on a voltage value detected by the hall device.

6. The refrigerator according to claim 5, wherein the controller maintains the door closed based on a number of times a voltage value is detected when the sensing member moves in the second direction.

7. The refrigerator according to claim 1, further comprising:

an elastic member configured to elastically bias the sensing member to a predetermined position when the sensing member moves in the first direction.

8. The refrigerator according to claim 1, further comprising:

an operator configured to open the door, wherein the controller controls the operator based on an amount of the movement of the sensing member while the sensing member is moving in the first direction.

9. The refrigerator according to claim 8, wherein the operator comprises:

a driving motor configured to provide a driving force; and a push member configured to receive the driving force from the driving motor, and to push the door in the second direction.

10. The refrigerator according to claim 9, wherein the operator further comprises:

a deceleration gear configured to reduce rotation displacement of the driving motor, to amplify a driving force of the driving motor, and to transfer the driving force of the driving motor to the push member.

11. The refrigerator according to claim 10, wherein the operator further comprises:

a rack gear portion configured to convert the rotation displacement of the deceleration gear to a linear displacement, and to be engaged with the deceleration gear.

12. The refrigerator according to claim 9, wherein when the sensing member moves in the first direction, the controller operates the driving motor, and when the sensing member moves in the second direction, the controller does not operate the driving motor.

13. The refrigerator according to claim 1, wherein the sensing member and the sensor are disposed on a top or a bottom of the door.

14. The refrigerator according to claim 1, wherein the sensor comprises:

a magnet; and a hall device disposed on one end of the sensing member, the hall device being configured to move, wherein the controller determines whether the sensing member moves in the first direction or the second direction based on a voltage value detected by the hall device.

15. The refrigerator according to claim 14, wherein the magnet is installed in the door.

16. A method of controlling a door of a refrigerator, the method comprising:

sensing a movement of a sensing member contacting the door while the door is closed, the sensing including sensing of whether the movement of the sensing member is in one of the first direction and the second direction that is opposite to the first direction;

controlling the door to be opened based on sensing of the sensing member in the first direction; and controlling the door to be maintained closed based on sensing of the sensing member in the second direction.

17. The method according to claim 16, wherein the controlling of the door to be maintained closed is based on a number of times the sensing member moves in the second direction.

18. The method according to claim 17, wherein the sensing of the movement of the sensing member in one of the first direction and the second direction comprises detecting a magnetic field change based on the movement of the sensing member.

19. The method according to claim 17, wherein the controlling of the door to be opened is based on an amount of the movement of the sensing member in the first direction.

20. The method according to claim 17, wherein the controlling of the door to be opened comprises controlling a push member configured to move the door in the first direction.

* * * * *